United States Patent [19]

Casella et al.

[11] Patent Number: 4,613,332

[45] Date of Patent: Sep. 23, 1986

[54] CONTROLLED GENERATION HYPOCHLORITE COMPOSITIONS AND METHOD

[75] Inventors: Victor M. Casella, Martinez; Ronald A. Fong, Modesto, both of Calif.

[73] Assignee: The Clorox Company, Oakland, Calif.

[21] Appl. No.: 629,695

[22] Filed: Jul. 11, 1984

[51] Int. Cl.[4] ..... D06L 3/02; D06L 3/04; C11D 3/395; C11D 7/54

[52] U.S. Cl. ..... 8/111; 252/95; 252/99; 252/186.38

[58] Field of Search ..... 252/99, 95, 96, 102, 252/186.38; 8/111

[56] References Cited

U.S. PATENT DOCUMENTS

| | | | |
|---|---|---|---|
| 3,035,431 | 5/1962 | Smith et al. | 68/207 |
| 3,154,494 | 10/1964 | Speak et al. | 252/96 |
| 3,197,271 | 7/1965 | Smith et al. | 8/137 |
| 3,415,608 | 12/1968 | Tucker | 8/10.2 |
| 3,458,446 | 7/1969 | Diaz | 252/99 |
| 3,822,114 | 7/1974 | Montgomery | 8/111 |
| 4,001,131 | 1/1977 | Montgomery | 252/99 |
| 4,028,263 | 6/1977 | Gray | 252/99 |
| 4,116,878 | 9/1978 | Deutscher et al. | 252/94 |
| 4,123,376 | 10/1978 | Gray | 252/99 |
| 4,146,496 | 3/1979 | Gray | 252/99 |
| 4,286,016 | 8/1981 | Dimond et al. | 252/95 |
| 4,300,897 | 11/1981 | Gray | 252/95 |
| 4,338,210 | 7/1982 | Clements et al. | 252/96 |
| 4,362,639 | 12/1982 | Eoga | 252/99 |
| 4,421,664 | 12/1983 | Anderson et al. | 252/94 |
| 4,499,001 | 2/1985 | Eoga | 252/99 |

OTHER PUBLICATIONS

American Potash & Chemical Corporation, Technical Service Report, "Ketone Activated Potassium Monopersulfate Bleach", Feb. 1, 1970.

*Primary Examiner*—Paul Lieberman
*Assistant Examiner*—John F. McNally
*Attorney, Agent, or Firm*—Majestic, Gallagher, Parsons & Siebert

[57] ABSTRACT

A dry bleaching composition, particularly useful for low temperature applications, is provided in which generation of hypochlorite by reaction between a peroxygen bleaching agent and a chloride salt is promoted by an aromatic diol or oxidized aromatic diol activator. Preferred activators are in ester form and provide hypochlorite generation at levels of less than about 20 ppm for at least about the first two minutes following dissolution of the compositions in aqueous solution, but rising to effective bleaching levels within a reasonable time thereafter. The initially low hypochlorite level assists in the functioning of laundry additives, such as fabric brighteners.

24 Claims, 1 Drawing Figure

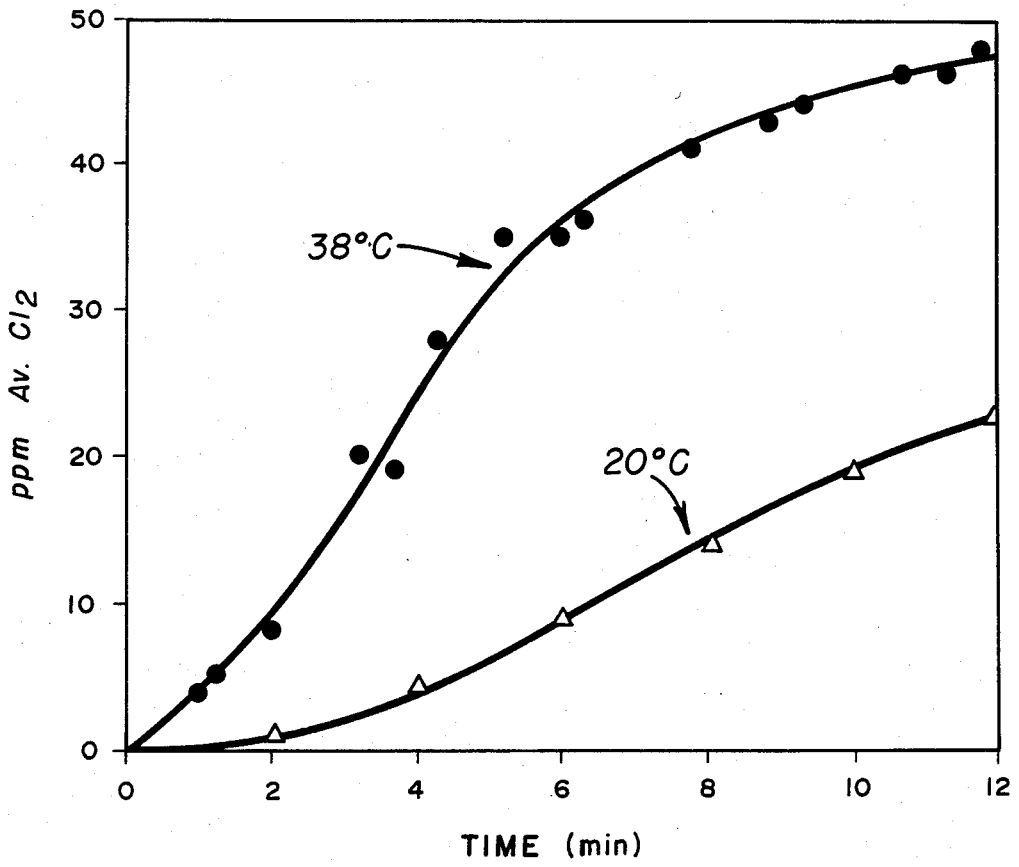
FIGURE I

CONTROLLED GENERATION HYPOCHLORITE COMPOSITIONS AND METHOD

FIELD OF THE INVENTION

The present invention generally relates to compositions which generate hypochlorite in aqueous solution, and more particularly to water soluble bleaching compositions in which the generation of hypochlorite is controlled.

BACKGROUND OF THE INVENTION

Chlorine bleaching compositions having hypochlorite as bleaching agent generally provide bleaching performance which is superior to oxygen-based compositions, such as those where the bleaching agent is perborate, percarbonate or peracid (e.g. diperazelaic, diperisophthalic and the like). Chlorine based bleaching compositions are known in both liquid and dry forms.

Among dry chlorine or bromine based compositions are those where halide ions (i.e. chloride or bromide) are oxidized by peroxymonosulfate to form hypochlorite or hypobromite following dissolution in aqueous solution. Thus, for example, U.S. Pat. No. 4,028,263, inventor Gray, issued June 7, 1977, discloses use of a peroxymonosulfate and a bromide source for hypobromite bleaching, and U.S. Pat. No. 4,116,878, inventor Deutscher et al., issued September, 1978, discloses a composition which generates hypobromite and includes amides, such as urea, to reduce dye damage.

Bromide is oxidized to form hypobromite at a considerably faster rate than chloride under similar conditions. Indeed, the oxidation of chloride by peroxymonosulfate under typical wash conditions is very slow, and the amounts of materials necessary to generate effective concentrations of hypochlorite for bleaching are not practical. Thus, activators have been sought for peroxymonosulfate bleaching systems, particularly for those generating hypochlorite.

In a technical service report dated Feb. 1, 1970 by American Potash & Chemical Corporation, it was reported that certain ketones (i.e. acetone, methyl ethyl ketone, methyl isobutyl ketone and cyclohexanone), activate monopersulfate bleach in the presence of an alkaline buffer providing a pH of at least 8. U.S. Pat. No. 3,822,114, inventor Montgomery, issued July 2, 1974 discloses peroxygen bleaching compositions which include a peroxygen bleaching compound, such as water-soluble monopersulfates and monoperphosphates, and an aldehyde or ketone activator compound for the peroxygen compound. The certain aldehydes or ketones disclosed are said to activate the peroxygen compounds in aqueous solution having a pH of about 7 to about 12, and a preferred embodiment includes the optional addition of a water-soluble chloride salt to yield bleaching of a hypochlorite type.

Because both chlorine and oxygen based bleaching systems tend to be incompatible with various other desirable laundry additives, such as enzymes and optical brighteners, attempts have been made to delay the formation of bleaching agent.

U.S. Pat. No. 4,421,664, inventors Anderson et al., issued Dec. 20, 1983 discloses an encapsulated oxidant bleach composition combined with a reducing agent which reduces the oxidant composition when released from the encapsulating coating and provides a delay in the concentration of oxidant bleach to permit functioning of an enzyme in the composition. The reducing agents include salts of sulfur oxyacids such as ammonium sulfite, sodium sulfite, sodium thiosulfite, sodium metabisulfite, potassium metabisulfite, and lithium hydrosulfite. The oxidant compounds include those capable of having chlorine liberated in the form of free chlorine or hypochlorite, such as alkali metal dichloroisocyanurate. Peroxy bleach compounds are also disclosed, including the alkaline metal salts of perborates, percarbonates, persilicates, persulfates, and perphosphates.

Thus, on one hand inorganic peroxygen bleaching compositions desirably include activators, particularly for monopersulfate and monoperphosphate systems generating hypochlorite, in order to provide effective concentrations of the bleaching agent under typical wash conditions; but, on the other hand it has been difficult to protect various desirable laundry additives from attack when effective bleaching concentrations of peroxygen bleaching agents are present.

SUMMARY OF THE INVENTION

Accordingly, it is an object of the present invention to provide a bleaching composition which is superior in bleaching performance to oxygen-based compositions while facilitating the inclusion and functioning of other desirable laundry additives.

In one aspect of the present invention, a bleaching composition comprises a peroxygen bleaching agent, preferably water-soluble monopersulfate or water-soluble monoperphosphate, a water-soluble chloride salt, and an activator which promotes reaction in aqueous solution between the peroxygen bleaching agent and the chloride salt. The activator is an aromatic diol or certain analogs thereof. The activator promotes formation of hypochlorite to effective levels of bleaching concentrations for laundry applications. Preferred embodiments of the invention are wherein the activator is in a precursor form so that the concentration of hypochlorite is at a level of less than about 20 parts per million for at least about 2 minutes following dissolution of the composition.

Accordingly, preferred bleaching compositions in accordance with the present invention provide controlled generation of the bleaching agent so that other desirable laundry additives can function during delayed hypochlorite formation but that effective bleaching concentrations are thereafter achieved. Further, compositions of the invention have an improved overall stain removal preformance. Preferred compositions of the invention are capable of generating relatively low levels of hypochlorite (for example 20–50 ppm Av.$Cl_2$) in a controlled manner at low temperatures which tends to reduce dye damage, and allow the inclusion of fabric brighteners which typically are not available for use in liquid hypochlorite bleaches.

Preferred activator presursors in accordance with the present invention are aromatic esters. A particularly preferred embodiment is a bleaching composition including p-phenylene diacetate as activator precursor which is carried along with surfactant on particles of the chloride salt.

BRIEF DESCRIPTION OF THE DRAWING

In the drawing,

FIG. 1 illustrates the hypochlorite generation (as parts per million available chlorine) over time of a preferred embodiment following dissolution in aqueous solution, as determined at two different solution temperatures.

DETAILED DESCRIPTION OF THE PREFERRED EMBODIMENTS

The oxidation of halide ions in aqueous solution is illustrated by reaction schemes 1(a) and 1(b) below.

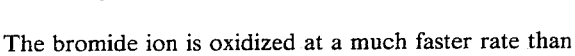

$$HSO_5^- + Cl^- \rightarrow {}^-OCl + SO_4^= + H^+ \quad 1(a)$$

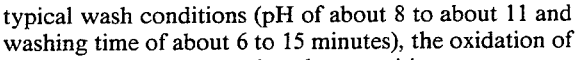

$$HSO_5^- + Br^- \rightarrow {}^-OBr + SO_4^= + H^+ \quad 1(b)$$

The bromide ion is oxidized at a much faster rate than chloride ion under similar conditions. Indeed, under typical wash conditions (pH of about 8 to about 11 and washing time of about 6 to 15 minutes), the oxidation of chloride ion is so slow that the quantities necessary to generate effective concentrations of hypochlorite are impractical.

Thus, for example, a composition providing $1.25\times10^{-3}$M of $HSO_5^-$ and $1.25\times10^{-1}$M of $Cl^-$ at pH 8 forms only about 4 ppm hypochlorite at 25° C. after 15 minutes, only about 2.3 ppm at pH 9.5 after 15 minutes, and less than 0.1 ppm after 15 minutes at about pH 11. These concentrations of hypochlorite are inadequate for acceptable bleaching performance. However, compositions capable of producing at least about 20 ppm hypochlorite within a reasonable time exhibit bleaching performance which is superior to perborate based bleaches and equivalent to peracid based bleaches.

It has been discovered that aromatic diols, or oxidized forms of aromatic diols, (sometimes hereinafter referred to as the "activator") dramatically increase the formation rate of hypochlorite from the oxidation of chloride ion by monopersulfate or monoperphosphate. Compositions of the invention include sufficient amounts of the essential activator (or precursor of the activator) so as to provide hypochlorite from reaction between chloride and peroxygen bleaching agent at effective concentrations under typical wash conditions.

Compositions in accordance with the present invention include three essential components: a peroxygen bleaching agent, a halide salt, and an activator or a precursor of the activator. Both the peroxygen bleaching agent and halide salt are water soluble, and react in aqueous solution to form the halide-based bleaching species.

Suitable peroxygen bleaching agents are water-soluble monopersulfates and water-soluble monoperphosphates. Preferred peroxygen bleaching agents include sodium monopersulfates, potassium monopersulfate, disodium monoperphosphate and dipotassium monoperphosphate. A particularly preferred peroxygen bleaching agent for compositions of the present invention is potassium monopersulfate which is commercially available from E. I. duPont de Nemours under the trade name "Oxone" ($2KHSO_5.KHSO_4.K_2SO_4$).

The water soluble halide salt in the invention is preferably an alkali metal chloride, such as sodium or potassium chloride. Sodium chloride is particularly preferred for reasons of ready availability and economy. Water soluble bromide salts (to generate hypobromite) could be used in compositions of the invention; however, since the generation of hypobromite by reaction of peroxygen bleaching agent and bromide ion is quite rapid, further promotion by means of an activator (or activator precursor) in accordance with the present invention would usually not be necessary.

Activators of the invention are aromatic diols or oxidized aromatic diols having an unsaturated ring which may include substituents. That is, in addition to the hydroxyl, carbonyl (or ester in the case of the activator precursor) groups on the unsaturated ring, various other groups may be substituted on the ring.

Table I, below, illustrates the dramatic increase in hypochlorite generation provided by two compositions in accordance with the present invention by contrast to a comparison composition with no activator. The concentration of $KHSO_5$ and NaCl provided in all three solutions was $1.25\times10^{-3}$M and $1.25\times10^{-2}$M, respectively. The concentration of activator in each of inventive compositions (a) and (b) was $1.25\times10^{-4}$M. (The weight percentages of components were calculated on compositional totals not including buffer).

TABLE I

| | ppm av. $Cl_2$* | time (min.) |
|---|---|---|
| inventive composition (a): | 14 | 1.25 |
| 20.46 wt. % $KHSO_5$ | 28 | 2.50 |
| 78.06 wt. % NaCl | 37 | 5.00 |
| 1.48 wt. % hydroquinone | 39 | 10.00 |
| (MW = 110) | 38 | 15.00 |
| inventive composition (b): | 26 | 1.25 |
| 20.46 wt. % $KHSO_5$ | 39 | 2.50 |
| 78.08 wt. % NaCl | 46 | 5.00 |
| 1.46 wt. % benzoquinone | 47 | 10.00 |
| (MW = 108) | 46 | 15.00 |
| comparison composition: | <1 | 1.25 |
| 20.76 wt. % $KHSO_5$ | <1 | 2.50 |
| 79.24 wt. % NaCl | <1 | 5.00 |
| | <1 | 10.00 |
| | <1 | 15.00 |

*determined at 21° C., pH 9.7 (0.10 M $CO_3^=/HCO_3^-$ Buffer)

As more fully discussed below, preferred compositions of the invention include activator in precursor form (sometimes herein referred to as the "activator precursor") having the structure illustrated by FIG. 2A, below.

FIG. 2A

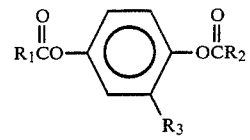

wherein one of $R_1$ and $R_2$ is an alkyl group having at least 1 to about 8 carbon atoms, the other is hydrogen or an alkyl group having at least 1 to about 8 carbon atoms, and $R_3$, if present, may be a substituent such as sulfonate, carboxylate, alkyl ethoxylate, quaternary ammonium or lower alkyl (e.g. methyl, ethyl or butyl).

Sulfonate, carboxylate and ammonium substituents generally increase the solubility of the activator precursor at lower temperatures, whereas lower alkyl substituents tend to reduce the activation property of the activator resulting from hydrolysis of the activator precursor. Lower alkyl substituents may thus be used in regulating the reaction rate.

Preferred activator precursors have two alkyl groups (that is, both of $R_1$ and $R_2$ are alkyl), and a particularly preferred activator precursor is p-phenylene diacetate (available, for example, from Eastman Kodak) and various derivatives thereof, such as 2,5-diacetoxy benzenesulfonic acid and salts thereof, 2,5-diacetoxy benzoic acid and salts thereof, 2,5-diacetoxy toluene and t-butyl-p-phenylene diacetate, as illustrated by FIG. 2B, below (wherein $M^+$ is an alkali ion, such as sodium).

FIG. 2B

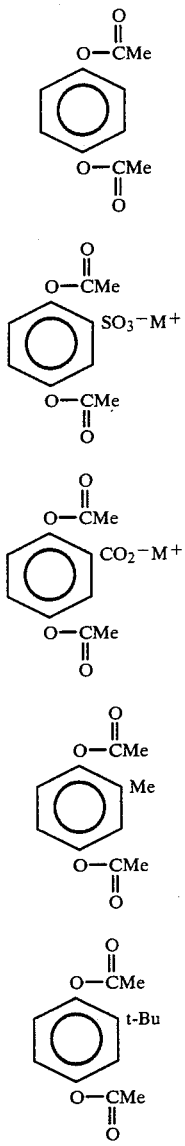

Where the activator is in ester form, as illustrated by FIGS. 2A and 2B, above, then it provides a dual function in compositions of the invention: the formation of hypochlorite is delayed in that the ester moieties first hydrolyze to hydroxyl groups, but once hydrolyzed the resultant activator then promotes, or catalyzes, reaction between the peroxygen bleaching agent and chloride salt.

Compositions of the invention have from about 5 wt% to about 80 wt.% peroxygen bleaching agent, from about 10 wt.% to about 70 wt.% of the halide salt, and from about 0.1 wt.% to about 10 wt.% of the activator or activator precursor. More preferably, the peroxygen bleaching agent is from about 25 wt.% to about 65 wt.%, the alkali halide salt from about 35 wt.% to about 45 wt.%, and the activator or activator precursor from about 0.5 wt.% to about 2 wt.%.

Preferred compositions provide that a sufficient amount of the activator forms to effectively promote a reaction producing hypochlorite in a controlled manner (e.g. wherein the formation of hypochlorite is at a level of less than about 20 ppm for at least about 2 minutes following dissolution of the composition in aqueous solution and rises to at least about 20 ppm within about 12 minutes following dissolution).

However, by varying the amount and form of activator precursor, the amount of peroxygen bleaching agent, and the amount of chloride salt, a wide range of hypochlorite generation concentrations and delay profiles may be obtained, if desired.

Compositions of the invention preferably include a buffering agent in an amount sufficient to maintain a pH within the range of from about 8 to about 11, more preferably from about 9 to about 10.5, when the compositions are dissolved in aqueous solutions, and may include other components for various purposes such as to aid in storage stability, to enhance or modify the solubilization rate of the activator precursor, in addition to including other well known laundry additives.

Suitable buffering agents for the present invention include sodium bicarbonate, sodium carbonate, disodium hydrogen phosphate, sodium dihydrogen phosphate, as well as other buffering components such as polyphosphates, hydroxides and zeolites. Sodium carbonate is a particularly preferred buffering agent for maintaining pH of the aqueous solution within a range of from about 9 to about 10.5. Buffering agents may be in an amount of from about 1 l wt.% to about 50 wt.% of the composition, more preferably about 5 wt.% to about 25 wt.%.

Drying agents, or dessicants, may be included to improve shelf life stability of the composition, particularly in humid conditions, and may be present from about 1 wt.% to about 50 wt.%, more preferably 5 wt.% to about 25 wt.%. For example, sodium sulfate, magnesium sulfate, and calcium sulfate are useful as dessicants, and may be simply admixed with the other components. Magnesium sulfate is a preferred drying agent for inclusion. Alternatively, compositions of the invention may be packaged in premeasured, single washload amounts, or by other conventional means, to protect against humidity.

Enzymes known and useful as laundry additives include hydrolases, such as carbohydrases (amylases), proteases and esterases (lipases). Preferred proteases, which attack protein-based stains such as blood and grass stains, include proteases available from Novo Industri, Copenhagen, Denmark, under the trade names Savinase, Alcalase, and Esperase. Among the commercially available amylases are those which attack carbohydrate and starch-based stains, such as an amylase available from Societe Rapidase under the trade name of Rapidase and from Miles Laboratories under the trade name of Milezyme.

Fluorescent whitening agents or brighteners are desirably present in compositions of the present invention, and include compounds such as Stilbene brighteners and their derivatives, Styrylnaphthalene brighteners and their derivatives, and Styrene brighteners and their derivatives. Exemplary Stilbene brighteners are disclosed in U.S. Pat. Nos. 3,951,960, 4,298,490, 3,993,659, 3,980,713 and 3,627,758. Whitening or brightening agents may be present in amounts of from about 0.05 wt.

% to about 5.0 wt. %, more preferably 0.10 wt. % to about 2.00 wt. %.

Surfactants may also be included in the inventive compositions, especially to enhance the solubilization of the activator precursor. Preferred amounts of surfactant are from about 0.1 wt.% to about 10 wt.%, more preferably 0.5 wt.% to about 2 wt.%. Nonionic surfactants are particularly useful in enhancing solubilization, and exemplary nonionics include primary alcohol ethoxylates (such as the Neodol series available from Shell Chemical Co.), block copolymers of propylene oxide (such as the Pluronic series available from BASF Wyandotte Corp.) and alkylaryl polyether alcohols (such as the Triton series available from Rohm and Haas Co.).

In the best mode contemplated for carrying about the present invention, surfactant and activator precursor are carried on a water soluble, particulate substrate, preferably on particles of the alkali chloride salt.

The surfactant and activator precursor may be coated on particulate substrate by means of a variety of conventional processes and apparatus. For example, the activator precursor may be co-dissolved with the surfactant in an organic solvent, such as acetone, and the solution then sprayed onto the particulate substrate. (The solution may be pumped with a conventional metering pump and sprayed through a plurality of conventional spray nozzles onto an evenly distributed bed of particles being moved, as on a conveyor belt, past the spray nozzles). Such a procedure yields substrate coated with a thin layer of surfactant and has the activator precursor dissolved within the layer.

Example I, below, illustrates the preparation of a preferred embodiment of the invention.

EXAMPLE I

NaCl Coated with Activator Precursor/Surfactant Blend

P-phenylene diacetate (0.81 g, mw=194.2) and 0.56 g of Neodol 25-12 (Shell Chemical Co.) were dissolved in 25 ml of acetone. The solution was added to a round bottom flask containing 40.3 g NaCl. The flask was connected to a laboratory roto-evap apparatus and the solvent removed from the sample under vacuum at room temperature while continuously rotating the flask to assure a uniform coating of the surfactant/precursor blend over the NaCl substrate.

Preparation of the Inventive Composition

The final composition was obtained by admixing 38.90 g of Oxone (%$KHSO_5$ content=40.7), 19.44 g of anhydrous $Na_2CO_3$ with 41.67 g of the NaCl coated with activator precursor/surfactant blend, prepared as described above.

The present invention provides a method for bleaching fabrics while reducing dye damage by cojointly dissolving sufficient amounts of a peroxygen compound, a chloride salt, and an activator precursor of an aromatic diol in an aqueous solution to provide from about 5 to about 80 ppm available oxygen, from about 10 to about 2000 ppm chloride ion, and from about 1 to about 500 ppm activator precursor, and contacting fabrics with this solution for at least about 2 minutes, more preferably for about 2 to about 12 minutes. The contacting may be at solution temperatures of from about 15° C. to about 50° C., and preferably is at temperatures of from about 20° C. to about 38° C. That is, in the best mode contemplated for practicing the present invention, the bleaching solution is tepid and thus preferred compositions are particularly useful as low temperature bleaches.

As the solution temperature increases, the amount of hypochlorite formed also increases and the time period for hypochlorite generation to rise to an effective bleaching level is decreased. This effect is illustrated by FIG. 1 where it can be seen that the hypochlorite generated (measured as ppm available $Cl_2$) at a solution temperature of 38° C. (100° F.) is less than 10 ppm within the first 2 minutes following dissolution, rises to about 20 ppm by about the third minute, and is almost 50 ppm by the twelfth minute, whereas at a solution temperature of 21° C. (70° F.) the hypochlorite is generated more slowly and has risen to about 20 ppm by the twelfth minute. The data illustrated by FIG. 1 was taken from solutions having the inventive composition embodiment whose preparation is described by Example I. The pH of the solution was 9.7.

Since the amount of any particular composition embodiment and the wash water volume determines the actual concentration of the components in solution, the general correlation between suitable weight percentages for each of the three necessary components in dry composition, parts per million, and concentration in aqueous solution is provided by Table II, below, where the amount of total composition dissolved is assumed as 4.4 g to 316.6 g and the solution is assumed as a volume of 681.

TABLE II

| Peroxygen bleaching agent: | | |
|---|---|---|
| wt. % ($KHSO_5$) | ppm available oxygen | concentration (as $KHSO_5$) |
| 73.2 to 16.3 | 5 to 80 | $3.12 \times 10^{-4}$ M to $5.00 \times 10^{-3}$ M |
| **Alkali halide salt:** | | |
| wt. % (NaCl) | ppm halide ion | concentration (as $Cl^-$) |
| 25.2 to 70.3 | 10 to 2000 | $2.82 \times 10^{-4}$ M to $5.64 \times 10^{-2}$ M |
| **Activator precursor:** | | |
| wt. % (ester precursor) | ppm activator precursor (MW about 200) | concentration (as precursor) |
| 1.5 to 13.4 | 1 to 500 | $5.00 \times 10^{-6}$ M to $2.50 \times 10^{-3}$ M |

Bleaching performance for compositions of the invention and the method for bleaching fabrics while reducing dye damage will now be further illustrated by Examples II through IV, below.

EXAMPLE II

The stain removal performance (ink and tea stain/100% cotton) of a representative bleach composition in accordance with the invention was compared to three comparison compositions. All treatments were evaluated in the presence of detergent, and a control treatment was performed with only detergent. The performance results are summarized in Table III, below.

TABLE III

| FORMULATION COMPOSITION | Composition Usage (g/l) | WASH WATER COMPOSITION [$KHSO_5$] × $10^3$ (PPM A.O.) | [NaCl] × $10^2$ (PPM Cl) | [PPD] × $10^5$ (PPM) | PERCENT STAIN REMOVAL (ΔE) 21° C. Ink | 21° C. Tea | 38° C. Ink | 38° C. Tea |
|---|---|---|---|---|---|---|---|---|
| TIDE ONLY (1.50 g/l) | — | — | — | — | 56.2 | 54.0 | 65.2 | 64.2 |
| TIDE + INVENTIVE COMPOSITION<br>38.90 wt. % Oxone****<br>40.29 wt. % NaCl<br>0.81 wt. % PPD*<br>0.56 wt. % Surfactant**<br>19.44 wt. % $Na_2CO_3$*** | 1.80 | 1.87(30) | 1.25(443) | 7.50(14) | 78.3 | 68.9 | 93.1 | 88.8 |
| TIDE + COMPARISON (1)<br>66.67 wt. % Oxone****<br>33.33 wt. % $NA_2CO_3$*** | 1.05 | 1.87(30) | — | — | 62.7 | 62.0 | 71.4 | 72.3 |
| TIDE + COMPARISON (2)<br>39.44 wt. % Oxone****<br>40.85 wt. % NaCl<br>19.71 wt. % $NA_2CO_3$*** | 1.78 | 1.87(30) | 1.25(443) | — | 64.6 | 62.2 | 75.2 | 72.2 |
| TIDE + COMPARISON (3)<br>65.14 wt. % Oxone****<br>1.36 wt. % PPD*<br>0.93 wt. % Surfactant**<br>32.57 wt. % $NA_2CO_3$*** | 1.07 | 1.87(30) | — | 7.50(14) | 62.3 | 61.7 | 69.4 | 69.0 |

*PPD = P—Phenylene Diacetate (MW = 194.2)
**Surfactant was Neodol 25-12
***$NA_2CO_3$ Level was Sufficient to Buffer Wash Water pH at 9.7 During the Wash Cycle
****% $KHSO_5$ Content = 40.7

The results are representative of tests conducted with other stains. The stain removal performance of the inventive composition embodiment is clearly superior to the control compositions at 21° C. and at 38° C. The hypochlorite generation profiles of the inventive composition are illustrated in FIG. 1 and the preparation is described in Example I. The higher concentration of hypochlorite generated at 38° C. versus 21° C. is reflected in the improvement in stain removal observed at the relatively higher temperature. At very high temperatures (above about 50° C.), the activation provided by the activator component tends to be reduced, and thus less hypochlorite is generated.

Example III, below, illustrates the effect of enhanced solubilization of the activator precursor by inclusion of surfactant on stain removal performance in compositions of the invention.

EXAMPLE III

Three embodiments of the invention were prepared and each utilized in conjunction with 1.50 g/l of detergent (Tide, available from Procter & Gamble) to wash three swatches of EMPA 115 bleach test cloth (available from Testfabrics Inc., Middlesex, N.J.). A control was washed with 1.50 g/l of detergent only. The wash cycle was for 12 minutes in a tergotometer at 100 rpm at a temperature of 23° C. and a pH of 9.7. The wash volume for each was 1 liter and the swatches after the wash cycle were rinsed for 3 minutes.

Inventive embodiments (1), (2) and (3) were prepared in the manner described in Example I with the following differences. No surfactant was included in the solvent during the preparation of inventive embodiment (1). Slightly higher levels of surfactant were used in inventive embodiment (2) and inventive embodiment (3), sufficient to yield 0.014 g/l and 0.028 g/l, respectively, when the compositions were evaluated in wash water. Table IV, below, illustrates the data from these studies. (The concentrations shown as those present in the wash water).

TABLE IV

| Treatment | [$KHSO_5$] × $10^3$ | [$Cl^-$] × $10^3$ | [PPD] × $10^5$ | surfactant *(g/l) | % stain removal |
|---|---|---|---|---|---|
| Tide only | — | — | — | — | 3.8 |
| Tide + Inventive Embodiment (1) | 1.87 | 1.25 | 7.50 | — | 17.6 |
| Tide + Inventive Embodiment (2) | 1.87 | 1.25 | 7.50 | 0.014 | 18.1 |
| Tide + Inventive Embodiment (3) | 1.87 | 1.25 | 7.50 | 0.028 | 19.8 |

*Neodol 25-12

As may be seen from Table IV, the inventive embodiment (1) having no surfactant in the bleaching composition itself (but present, of course, in the detergent added to the washing solutions) performed less well in stain removal than did inventive embodiments (2) and (3). It is believed that this enhanced stain removal is due to the activator precursor being more readily solubilized when dispersed in the surfactant film coated upon the sodium chloride.

Among the advantages of preferred compositions of the invention is the ability to include fabric brighteners, since it is well known that brighteners are sensitive to degradation by bleaching agents. This is demonstrated by Example IV, below.

EXAMPLE IV

Swatches of 100% cotton were washed in 6 solutions for a 12-minute wash cycle at 38° C. In three of the solutions, the only source of brightener was that present as an additive in detergent, whereas in the other three solutions 10 mg/l of brightener (Tinopal 5BMX, available from Ciba-Geigy) was additionally added to the wash liquor of each solution. The quantity of detergent added to each of the 6 solutions was 1.50 g/l (Tide) and the pH of all solutions was 9.7. The reflectance of the cotton swatches treated in the respective 6 solutions was then measured and Δ Whiteness was calculated by subtracting the initial reflectance from the final reflectance. (That is, Δ Whiteness increases as brightener deposition increases). The data of Table V illustrates the results of these studies.

TABLE V

| Treatment | Reflectance (Δ Whiteness) Without additional Brightener | With additional Brightener |
|---|---|---|
| Tide | 15.3 | 18.2 |
| Tide + 200 ppm Av.$Cl_2$ | 10.0 | 15.2 |
| Tide + inventive embodiment (4) | 15.8 | 17.2 |
| [$KHSO_5$] = $1.87 \times 10^{-3}$ M (30 ppm available oxygen) | | |
| [Cl] = $1.25 \times 10^{-2}$ M (443 ppm) | | |
| [p-phenylene diacetate] = $7.50 \times 10^{-5}$ M (14 ppm) | | |

The data of Table V demonstrate that there is fabric brightening benefit when fabric brightener is included with a composition of the invention (inventive embodiment 4). The fabric brightening obtained from inventive embodiment (4) was equivalent to that obtained using detergent alone, and was greatly superior to that obtained by detergent plus a 200 ppm average $Cl_2$ (which represents a conventional liquid hypochlorite bleach). Thus, when brightener is included in compositions of the invention, the data show that fabric brightening is less affected by the presence of hypochlorite.

While the invention has been described in connection with specific embodiments thereof, it will be understood that it is capable of further modification, and this application is intended to cover any variations, uses or adaptations of the invention following, in general, the principles of the invention and including such departures from the disclosure as come within the known or customary practice in the art to which the invention pertains and as may be applied to the essential features hereinbefore set forth, and as fall within the scope of the invention and the limits of the appended claims.

What is claimed:

1. A bleaching composition comprising:

from about 5 wt.% to about 80 wt.% of a peroxygen bleaching agent selected from the group consisting essentially of water-soluble monopersulfates and water-soluble monoperphosphates;

from about 10 wt.% to about 70 wt.% of a water-soluble chloride salt; and, an activator in an amount of from about 0.1 wt.% to about 10.0 wt.% of the composition to promote reaction in an aqueous solution between the peroxygen bleaching agent and the chloride salt and to produce hypochlorite therefrom, the activator selected from the group consisting essentially of an aromatic diol, or a hydrolyzable ester thereof, benzoquinone or a substituted benzoquinone.

2. The bleaching composition as in claim 1 further comprising a buffering agent in an amount sufficient to maintain a pH within the range of from about 8 to about 11 when the composition is dissolved in an aqueous solution.

3. The bleaching composition as in claim 1 where the activator has the structure

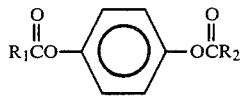

wherein one of $R_1$ and $R_2$ is hydrogen or a substituted or unsubstituted alkyl group and the other of $R_1$ and $R_2$ is hydrogen or a substituted or unsubstituted alkyl group.

4. The bleaching composition as in claim 3 wherein the ring of the activator has a sulfonate, carboxylate, methyl, or t-butyl substituted thereon at an ortho position.

5. A dry composition, useful for bleaching in laundry solutions, comprising:

from about 25 wt.% to about 65 wt.% of a water-soluble monopersulfate;

from about 35 wt.% to about 45 wt.% of a water-soluble chloride salt; and, from about 0.5 wt.% to about 2 wt.% of a hydroquinone precursor, the hydroquinone precursor being hydrolyzable in aqueous solutions to a hydroquinone, the hydroquinone promoting reaction between the monopersulfate and the chloride salt with formation of hypochlorite therefrom.

6. The composition as in claim 5 wherein the formation of hypochlorite is at a level of less than about 20 p.p.m. for at least about 2 minutes following dissolution of the composition in aqueous solution, and the hypochlorite formed within about 12 minutes following dissolution is at least about 20 p.p.m.

7. The composition as in claim 6 wherein the hypochlorite is in the range of between about 20 to about 60 p.p.m. from about 2 minutes to about 12 minutes after dissolution of the composition in aqueous solution.

8. The composition as in claim 7 wherein the hypochlorite is formed at aqueous solution temperatures between about 15° C. to about 50° C.

9. The composition as in claim 6 further comprising an optical brightening agent, an enzyme, a surfactant, a dessicant, or mixtures thereof.

10. The composition as in claim 5 wherein the hydroquinone precursor is admixed with surfactant and the admixture is coated upon particles of the chloride salt.

11. The composition as in claim 6 further comprising a buffering agent in an amount sufficient to maintain a pH within the range of from about 9 to about 10.5 when the composition is dissolved in an aqueous solution.

12. The composition as in claim 6 wherein the hydroquinone precursor has at least one acyl group linked to a phenyl group via an ester linkage.

13. The composition as in claim 6 wherein the hydroquinone precursor has two acyl moieties linked in a para position to a phenyl group via ester linkages.

14. The composition as in claim 5 wherein the hydroquinone precursor is a substituted or unsubstituted p-phenylene diacetate.

15. A low temperature, dry bleaching composition comprising:

from about 35 wt.% to about 65 wt.% of a water-soluble peroxygen bleaching agent;

from about 35 wt.% to about 45 wt.% of a water-soluble chloride salt;

from about 0.75 wt.% to about 1.5 wt.% of an activator precursor having the structure

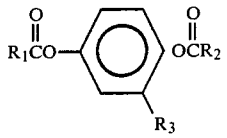

wherein one of $R_1$ and $R_2$ is an alkyl group having at least 1 to about 8 carbon atoms and the other is hydrogen or an alkyl group having at least 1 to about 8 carbon atoms, and $R_3$ is hydrogen, sulfonate, carboxylate, methyl, or t-butyl; and, from about 15 wt.% to about 35 wt.% of a buffering agent to maintain a pH of the composition during use within the range of from about 9 to about 10.5.

16. The composition as in claim 15 further comprising at least one laundry additive, a drying agent, or mixtures thereof.

17. The composition as in claim 15 wherein the activator precursor is coated upon a water soluble substrate.

18. The composition as in claim 17 wherein the water soluble substrate includes the water soluble chloride salt.

19. The composition as in claim 17 wherein the water soluble substrate carries surfactant thereon.

20. The composition as in claim 15 wherein the activator precursor includes p-phenylene diacetate.

21. A method for bleaching fabrics while reducing dye damage comprising:

cojointing dissolving a peroxygen compound, a chloride salt and an activator precursor having the structure

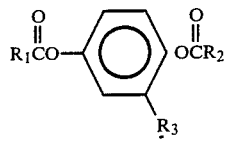

wherein $R_1$ and $R_2$ are alkyl groups having at least 1 to about 8 carbon atoms and $R_3$ is hydrogen, sulfonate, carboxylate, or lower alkyl in an aqueous solution at a temperature of from about 20° C. to about 38° C.; and, contacting fabrics with said solution for at least about 2 minutes.

22. The method as in claim 21 wherein the peroxygen compound includes potassium monopersulfate and the dissolving provides from about $1.25\times10^{-3}$M to about $2.5\times10^{-3}$M monopersulfate, from about $7.5\times10^{-3}$M to about $2.0\times10^{-2}$M chloride, and from about $5.0\times10^{-5}$M to about $1.0\times10^{-4}$M activator precursor in said solution.

23. The method as in claim 22 wherein the contacting is for at least about 6 minutes.

24. The method as in claim 22 wherein the activator precursor is hydrolyzed to an activator having the structure

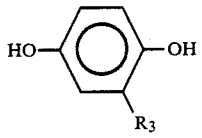

to promote reaction between the monopersulfate and the chloride in said solution during the contacting.

* * * * *